US005367966A

United States Patent [19]

Bellio et al.

[11] Patent Number: 5,367,966

[45] Date of Patent: Nov. 29, 1994

[54] AUTOMATIC EDGE SEWING SYSTEM AND METHOD

[75] Inventors: Stephen L. Bellio, West Roxbury; James F. Mueller, North Reading, both of Mass.

[73] Assignee: The Charles Stark Draper Laboratory, Inc., Cambridge, Mass.

[21] Appl. No.: 255,406

[22] Filed: Jun. 8, 1994

[51] Int. Cl.[5] ..... D05B 21/00

[52] U.S. Cl. ..... 112/121.12; 112/308; 112/262.3

[58] Field of Search ..... 112/121.12, 121.15, 112/121.11, 148, 153, 262.3, 306, 308, 309, 153

[56] References Cited

U.S. PATENT DOCUMENTS 5,018,462 5/1991 Brocklehurst ..... 112/121.12
5,131,339 7/1992 Goodridge ..... 112/121.12 X
5,178,080 1/1993 Nomura et al. ..... 112/121.12
5,186,115 2/1993 Rouleau et al. ..... 112/306

*Primary Examiner*—Peter Nerbun
*Attorney, Agent, or Firm*—Joseph S. Iandiorio

[57] ABSTRACT

An automatic edge sewing system and method for sewing together the edge of a plurality of parts in which the parts to be sewn are clamped together in a sewing machine having a reciprocating needle; the parts are mounted for rotation about a first rotational axis through the pans and for linear translation along a linear axis between the first rotational axis and the axis of the needle. The pans are steered about a second rotational axis parallel to the needle axis for adjusting the angular position of the linear axis about the needle axis. The parts are fed through the needle axis and the position of the edge of the parts proximate the needle axis is sensed; the steering and the feeding of the parts through the needle axis is controlled in response to the sensing of the edge position while the pans passively float about the first rotational axis and along the linear axis to enable the parts to be sewn accurately, automatically proximate the edges.

14 Claims, 6 Drawing Sheets

AUTOMATIC EDGE SEWING SYSTEM AND METHOD

FIELD OF INVENTION

This invention relates to an automatic edge sewing system for sewing together the edge of a number of parts.

BACKGROUND OF INVENTION

Manual sewing of parts is slow, expensive, and not always uniform, which makes it especially unappealing for mass production applications such as sewing together leather or vinyl material and foam rubber backing for automobile seats. One attempt at automating the sewing process is quite complex as it employs a three axis robotic system that controls the movement of the parts in the x, y and theta positions as well as the sewing machine speed. One shortcoming of such a system is that it cannot easily accommodate even minor variations in part size. This is so because the parts to be sewn are moved through the sewing machine on a predetermined path that has been established in a prior learning mode: there is no sensor feedback to adjust for variations in the part shape or size or changes in operating conditions. Typically, in such systems, the presser feet and feed mechanisms of the sewing machine must be disconnected to avoid conflict with the predetermined course being executed.

SUMMARY OF INVENTION

It is therefore an object of this invention to provide an improved automatic edge sewing system and method for sewing together the edge of a plurality of parts.

It is a further object of this invention to provide such a system and method which is reliable and tolerant to part size differences.

It is a further object of this invention to provide such a system which is simpler and less expensive to implement.

It is a further object of this invention to provide such a system which requires only one actively controlled axis in addition to the feeding of the pans through the sewing machine.

The invention results from the realization that a truly simple, effective edge sewing system can be achieved by permitting the parts to be sewn to float about a first rotational axis through the parts and that first rotational axis be permitted to float along a linear axis and that linear axis intersecting and being rotatable about the sewing machine needle axis. Edge position information from a sensor located in front of the sewing needle is used to control the angle of the linear axis. This configuration results in the application of only a steering force about the needle axis.

This invention features an automatic edge sewing system for sewing together the edge of a plurality of parts. There is a clamp assembly for securing together the pans to be sewn and a rotation assembly for enabling the clamp assembly and pans to passively rotate about a first rotational axis through the clamp assembly and pans. The sewing machine has a needle reciprocally driven along a needle axis transverse to the clamp assembly and parts. A linear beating assembly enables the clamp assembly and parts to passively translate along the linear axis between the first rotational axis and the needle axis. A steering assembly rotatable about a second rotational axis parallel to the needle axis adjusts the angle of the linear axis about the needle axis. A feed mechanism feeds the parts through the needle axis. A sensor senses the position of the edge of the parts proximate the needle axis. A control means responsive to the edge sensor rotates the steering assembly and controls the feed mechanism to drive the part through the needle axis while the clamp assembly and parts passively float about the first rotational axis and along the linear axis to enable the parts to be sewn accurately automatically proximate their edges.

In a preferred embodiment the clamp assembly may include a pair of plates. The clamp assembly may also include a linear actuator for urging together the plates with the parts to be sewn between them. The rotation assembly may include a rotary bearing mechanism and the rotary beating mechanism may include a rotary beating associated with each of the plates. The first rotational axis may be the centroidal axis of the plates and/or parts. The second rotational axis may be coincident with the needle axis. The edge sensor may include a retro-reflective proximity sensor. The control means may include a steering assembly, a feed drive for operating the feed mechanism, and a microprocessor responsive to the edge sensor, the steering drive and the feed drive for controlling the steering drive and the feed drive. The steering drive may include a position encoder and the feed drive may include a position encoder. There may be a comer sensor for detecting when a comer of the edge of the parts is approaching the needle axis.

The invention also features an automatic edge sewing method for sewing together the edge of a plurality of parts. The parts to be sewn are clamped together in a sewing machine having a reciprocating needle. The parts are mounted for rotation about a first rotational axis through the parts and for linear translation along the linear axis between the first rotational axis and the axis of the needle. The parts are steered about a second rotational axis parallel to the needle axis for adjusting the angle of the linear axis about the needle axis. The parts are fed through the needle axis and the position of the edge of the parts is sensed proximate the needle axis. The steering and the feeding of the parts through the needle axis is controlled in response to the sensing of the edge position while the parts passively float about the first rotational axis and along the linear axis to enable the parts to be sewn accurately, automatically proximate the edges.

In a preferred embodiment the first rotational axis may be the centroidal axis of the parts and/or plates, and the second rotational axis may be coincident with the needle axis.

DISCLOSURE OF PREFERRED EMBODIMENT

Other objects, features and advantages will occur to those skilled in the art from the following description of a preferred embodiment and the accompanying drawings, in which.

Figure 1:
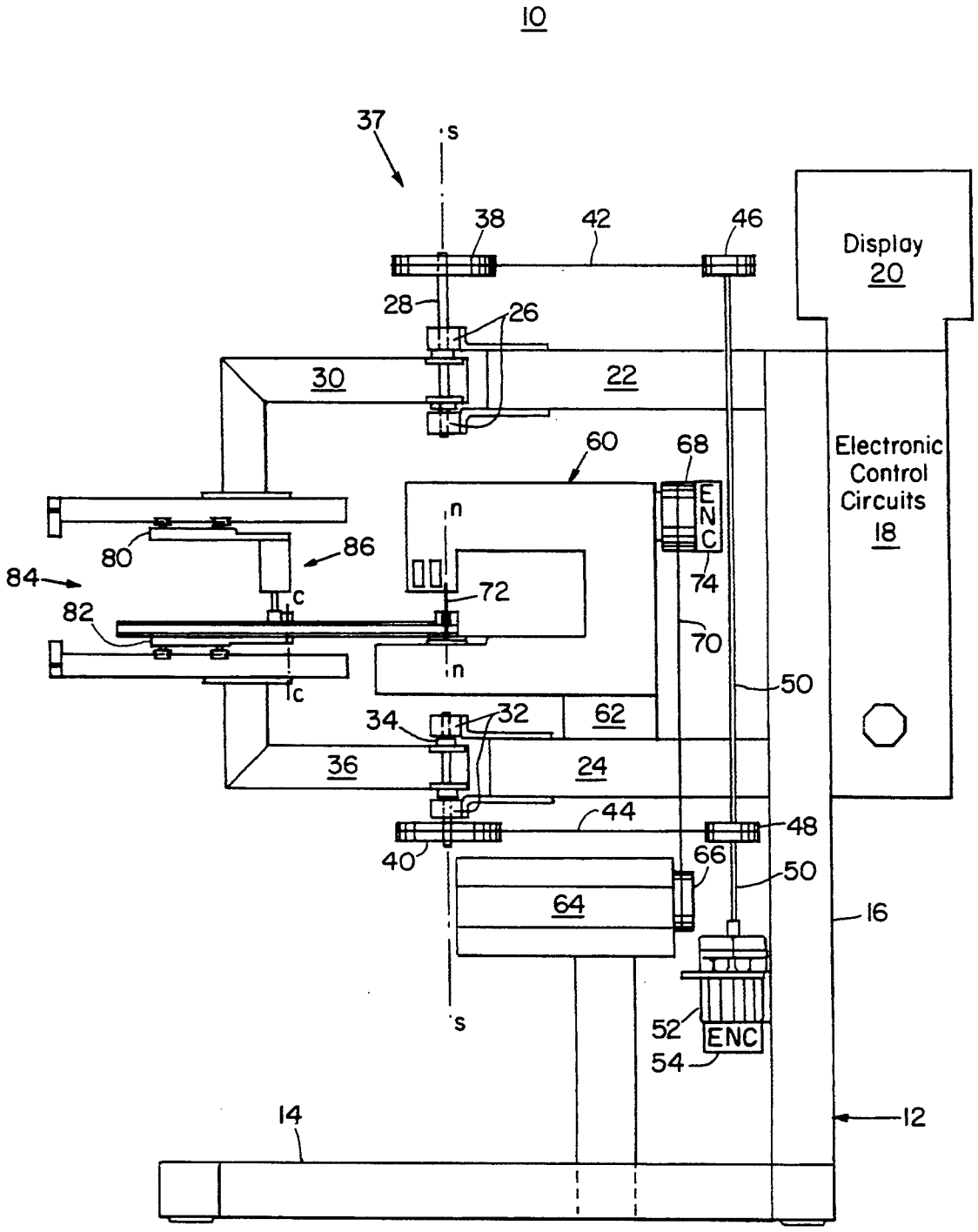
FIG. 1 is a side elevational diagrammatic view of an automatic edge sewing system according to this invention.

There is shown in FIG. 1 an automatic edge sewing system 10 according to this invention including a frame 12 having a base 14 and tower 16. Tower 16 carries electronic control circuits 18 and display 20 for the use by the operator. Tower 16 also supports fixed upper arm 22 and fixed lower arm 24. Fixed upper arm 22 has a pair of bearings 26 which rotatably receive shaft 28 that enables rotatable upper arm 30 to be steered about shaft 28. Similarly, fixed lower arm 24 includes a pair of bearings 32 which rotatably receive shaft 34 which enables lower rotatable arm 36 to be rotated about the axis of shaft 34. The axis of shaft 34 is noted as axis s—s. The steering mechanism 37 for rotatable arms 30 and 36, in addition to bearings 26 and 32 and shafts 28 and 34, includes pulleys 38 and 40 attached to shafts 28 and 34, respectively. Pulleys 38 and 40 are driven by belts 42 and 44, respectively, which in turn are driven by pulleys 46 and 48 which are mounted on shaft 50 driven by motor 52. The position of motor 52 is monitored by position encoder 54. Lower fixed arm 24 supports sewing machine 60 on block 62. Sewing machine 60 is driven by motor 64 via pulleys 66 and 68 and belt 70. The operation of reciprocating needle 72 of sewing machine 60 is monitored by encoder 74. Needle 72 reciprocates along needle axis n—n. Axes s—s and n—n are generally parallel to one another and in this preferred embodiment as shown are coincident with one another as well. Upper and lower rotating arms 30 and 36 support linear bearing assembly 84 which includes upper and lower linear bearing assemblies 80 and 82. Linear bearing assembly 84 supports clamp assembly 86.

Figure 2:
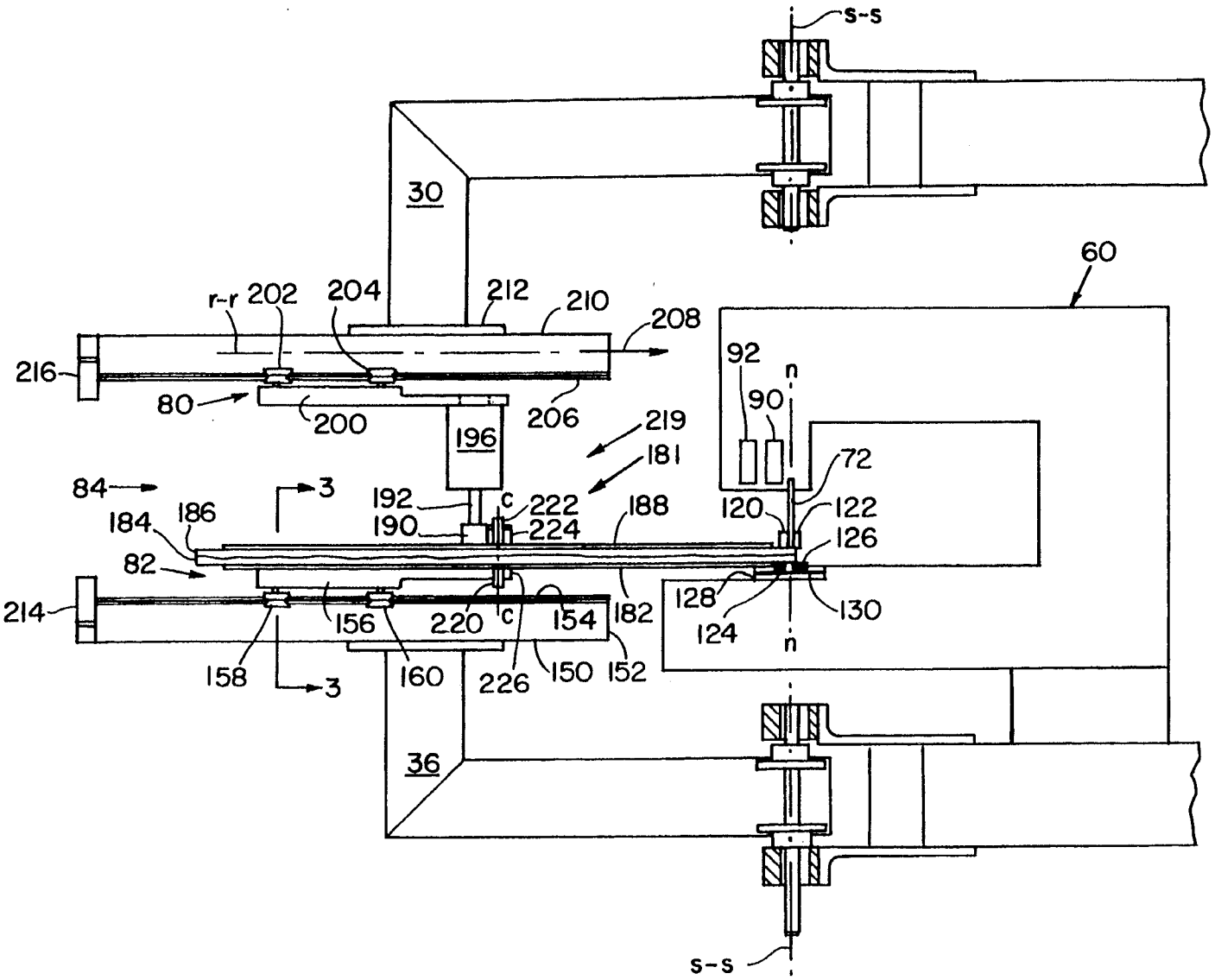
FIG. 2 is an enlarged, more detailed view of the clamp assembly, rotation assembly and sewing machine of FIG. 1.

Linear bearing assembly 84, clamp assembly 86, and sewing machine 60 are shown in greater detail in FIG. 2, where it can be seen that sewing machine 60 includes an analog edge sensor 90 and a corner sensor 92. The corner sensor 92 can be any conventional retro-reflective photoelectric sensor. Edge sensor 90 is typically a retroreflective type sensor made by Leuze Electronic, Sick optick electronik, Skan-A-Matic, or Datalogic. In the preferred embodiment a Datalogic model RTO-0-3 was used to implement sensor 90. The sensor provides an analog signal proportional to the light received back from retro-reflective tape. In addition, a cylindrical lens 108 is used to produce an elongated field of view 106. Light from emitter 102 is transmitted through beamsplitter 100, lens 110, and lens 108 onto the retro-reflective medium. Light is returned from the retro-reflective medium, through lenses 108 and 110, reflected off of beamsplitter 100 and onto detector 104. Sewing machine 60, FIG. 2, includes a pair of presser feet 120, 122 on either side of needle 72, and feed dogs 124 and 126 in the base 128.

Figure 3:
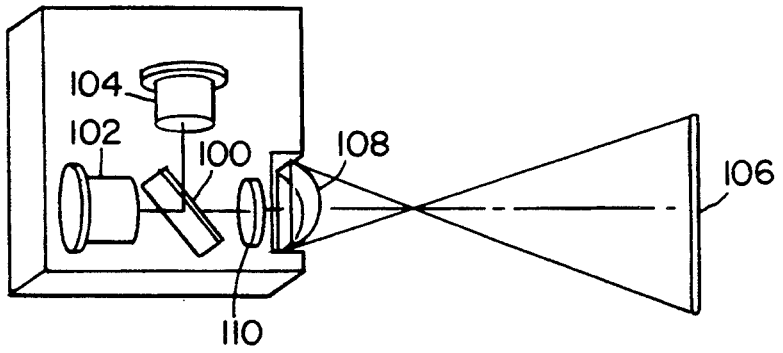
FIG. 3 is an enlarged diagrammatic detailed view of the edge sensor of FIGS. 1 and 2.
Figure 4:
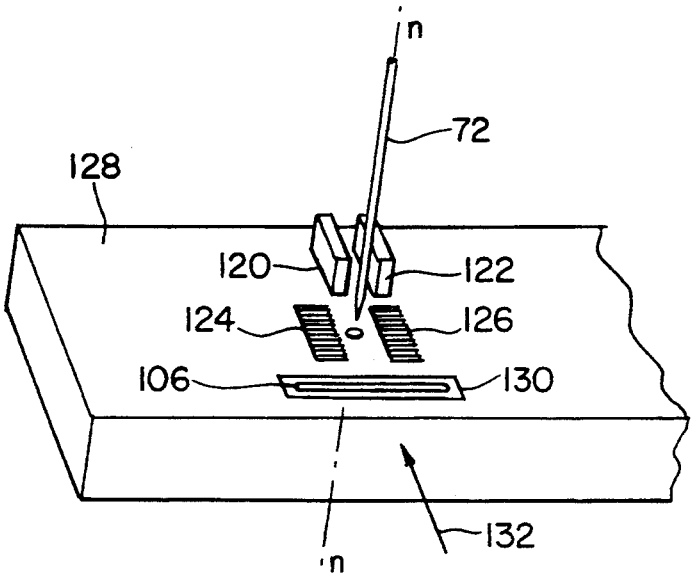
FIG. 4 is a perspective view of the sewing head of the sewing machine of FIGS. 1 and 2.

A retro-reflective medium 130 is provided on base 128 to reflect light back to edge sensor 90. This can be seen more clearly in FIG. 4, where needle 72 is clearly shown between presser feet 120 and 122 with feed dogs 124 and 126 mounted in base 128 and retro-reflective medium 130 disposed just ahead of needle axis n—n in the feed direction 132. Field of view 106, FIG. 3, of edge sensor 90 is superimposed on retroreflective medium 130, FIG. 4.

Figure 5:
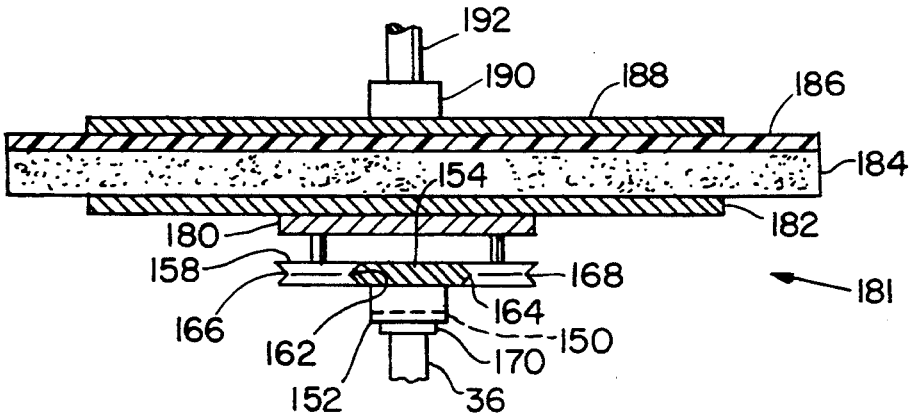
FIG. 5 is an enlarged detailed cross-sectional diagram of the clamp assembly of FIGS. 1 and 2.

As previously indicated, linear bearing assembly 84 includes upper linear bearing 80 and lower linear bearing 82, FIG. 2. Lower linear bearing includes support bars 150 and 152 which support V rail 154. Carriage 156 includes two pairs of V groove pulleys 158, 160, only one of each pair being shown, which ride on V rail 154. This construction is shown in more detail in FIG. 5, where V rail 154 is shown as having two V shaped edges 162, 164 which engage with the V grooves 166, 168 on the pulleys of pulley pair 158. Support bar 150 is mounted on flange 170 of lower rotating arm 36. Lower support plate 182, FIG. 5, is fixably mounted to carriage 180, which carries two or more parts 184, 186 to be sewn together at their edge portions. For example, part 184 could be foam rubber backing and part 186 could be a leather or vinyl covering such as for automobile upholstery. Although in this illustration there are but two parts being sewn together, this is not a necessary limitation of the invention, as three, four or any number may be sewn. An upper support plate 188 is disposed on top of parts 186 and 184 and is held there by clamp foot 190 under the urging of shaft 192.

Shaft 192, FIG. 2, is driven by linear actuator 196 which is carried by carriage 200 of upper linear bearing assembly 80. Clamp assembly 181 includes upper and lower plates 182, 188, foot 190, shaft 192 and actuator 196. Carriage 200, like carriage 156, includes two pairs of V group pulleys 202, 204, only one of each pair being shown in FIG. 2, which ride on V rail 206 supported by bars 208 and 210. Bar 210 is mounted to flange 212 of arm 30, all in a similar fashion as shown with respect to the lower linear bearing 82. Stops 214 and 216 are provided at the ends of rails 154 and 206 to limit the motion of linear carriages 156 and 200, respectively. Linear bearing assembly 84 thus permits the entire clamp assembly 181 to move linearly to translate along axis r—r.

Upper and lower support plates 188 and 182, FIG. 2, are rotatably mounted for rotation about rotational axis c-c by means of a rotational assembly 219 which includes pins 220, 222 fixed to upper and lower support plates 182 and 188, respectively, and journaled in bearings 224, 226, respectively. This rotational assembly allows support plates 182 and 188 and parts 184 and 186 to rotate freely about axis c—c as required by the operation of feed dogs 124, 126. At the same time, linear bearings 80 and 82 permit the entire clamp assembly 181 to linearly translate along axis r—r between rotational axis c—c and needle axis n—n. In this manner the entire clamp assembly 181 including support plates 182, 188 and the parts to be sewn 184, 186, are allowed to passively float along axis r—r and support plates 182, 188 and the parts to be sewn 184, 186, are allowed to passively float about axis c—c as required by the operation of feed dogs 124, 126 as the edge of the parts to be sewn are fed through the needle axis n—n. Axes c—c, s—s, and n—n are generally parallel to one another and axis r—r is generally perpendicular to them.

Figure 6:
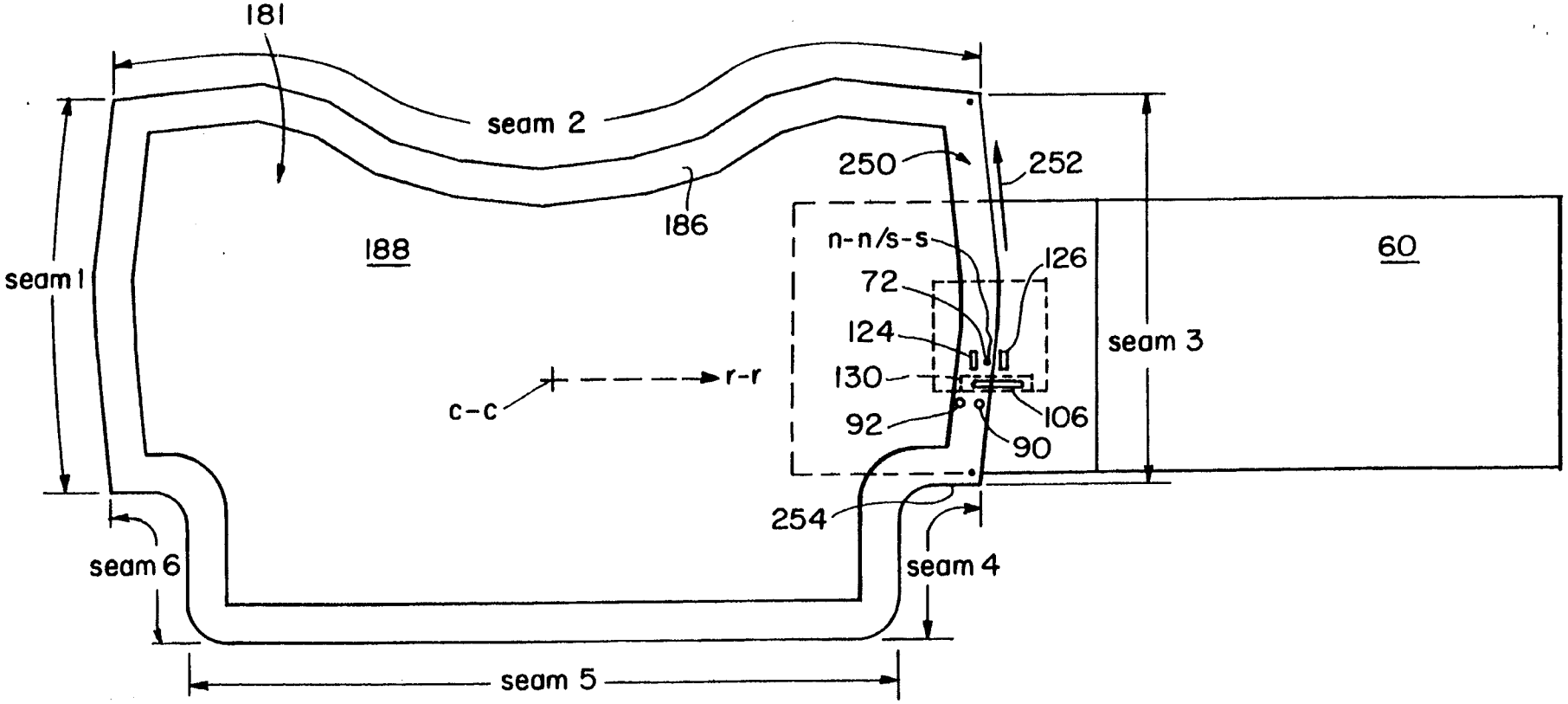
FIG. 6 is a top plan diagrammatic view showing a sewing operation according to this invention for sewing together two or more parts about their edge.

This can be seen more clearly in operation, FIG. 6, with axis c—c being preferably disposed at the centroid of the parts which includes an edge having six seam sections labeled seam 1–seam 6. As feed dogs 124 and 126 drive the edge portion 250 of parts 186 and 188 through the axis n—n of needle 72 in a direction shown by arrow 252. Edge sensor 90 derives a signal indicating the location of the edge within its field of view 106. As the feed dogs drive the edge portion 250 in the direction shown by arrow 252, the parts have a tendency to rotate counter-clockwise resulting in the more of the edge in the field of view 106. Edge sensor 90 produces an error signal that is delivered to the electronic control circuits 18, FIG. 1, which operate steering assembly 37 through motor 52 and the related pulleys, shafts and belts, to reorient the upper and lower rotatable arms 30 and 36 to reposition the parts 186 and 184. Using typical control methods which are proportionally responsive to an error signal the system can work at high sewing speeds controlling the position of parts 186 and 184 to maintain the proper edge position.

Figure 7:
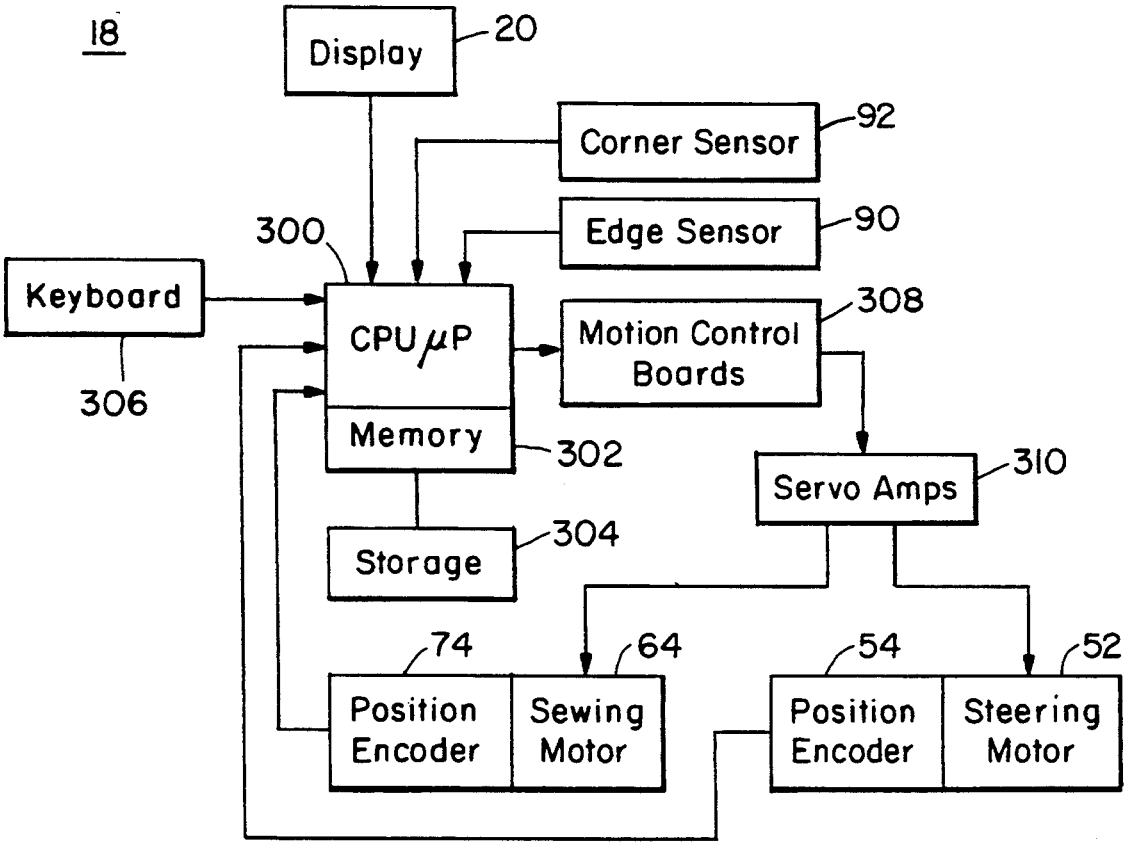
FIG. 7 is a schematic block diagram of the electronic control circuits of FIG. 1.

Control circuit 18, FIG. 7, includes a microprocessor 300 typically having memory 302, storage 304 and keyboard 306 associated with it, is used to drive motion control boards 308, such as TR NODE available from Teknic Inc., which drive servo amplifiers 310. Servo amplifiers 310 directly operate sewing motor 64 and steering motor 52. The operation of motors 52 and 64 is monitored by position encoders 54 and 74, whose outputs are connected to microprocessor 300. Also connected to microprocessor 300 are the outputs from edge sensor 90 and corner sensor 92.

Figure 8:
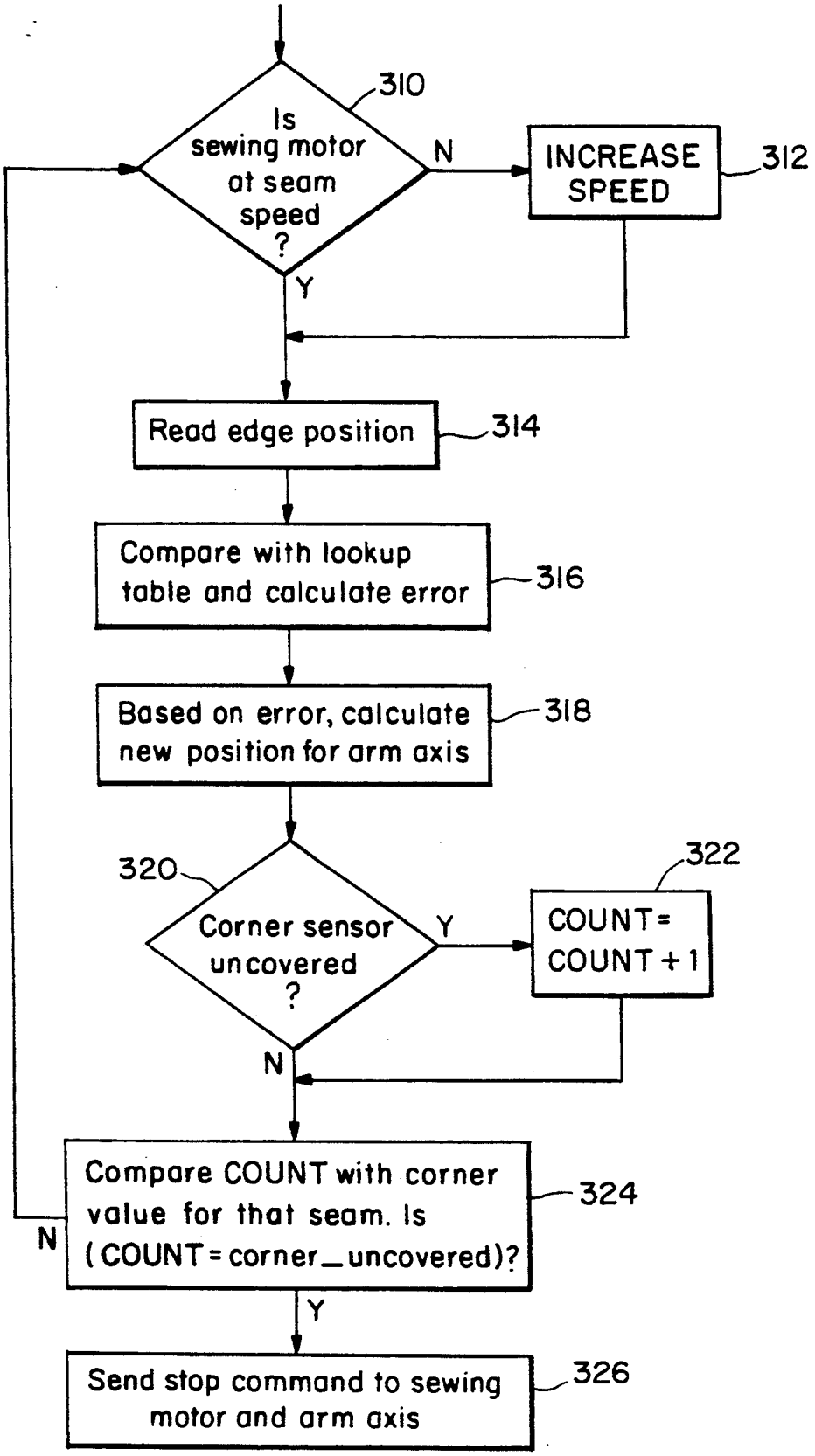
FIG. 8 is a flow chart for operating the microprocessor of FIG. 7 to perform the edge sewing method according to this invention.

In operation, microprocessor 300 is programmed, as shown in FIG. 8, to first question whether the sewing motor is at seam speed, step 310. If it is not, then an increase in speed is called for in step 312. At step 314, the edge position is read from edge sensor 90. This is compared with a value in lookup table 316 and any error is calculated. Based on the error calculated, step 318, the new position is determined for the steering assembly 37. If the comer sensor has become uncovered 320, then a counter is incremented, 322. At step 324, the system compares the count with the corner value for that seam with the inquiry: Is the count equal to the corner uncovered count? If it is, a stop command 326 is sent to the sewing motor 64 and steering motor 52. If the count is not equal to the comer uncover count then the system returns to step 310 and checks to see that the sewing motor is operating at the same speed.

Figure 9:
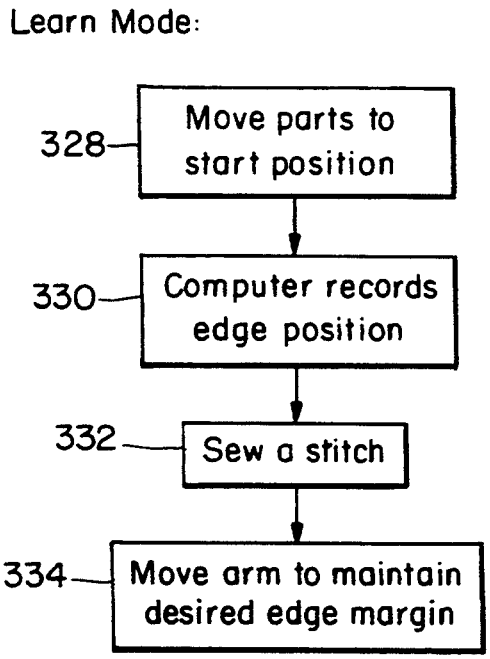
FIG. 9 is a flow chart of the software used in the microprocessor of FIG. 7 in the learning mode to define the lookup table of FIG. 8.

The lookup table for determining errors in the orientation of the edges being sewn is created in the learn mode, FIG. 9, by moving the parts to be sewn to the start position at the beginning of seam 1,328. The computer is then enabled to record the edge position (330) and a stitch is sewn (332). The steering assembly 37 is then moved to maintain the desired edge margins 334 and the computer records the edge position again at 330. This continues while the parts are moved through their entire sewing course to establish the lookup table from which the error is calculated in step 316, FIG. 8. A stop command being sent means that the system has completed a seam. If so, the seam count is incremented. If the current number of seams sewn is less than the total number for that part then the system proceeds to sew the next seam. At this point the needle is down and piercing the corner of the part. The presser foot lifts and the parts are driven counter-clockwise until the edge sensor is satisfied. The feed dogs lower and that seam is then sewn.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. An automatic edge sewing system for sewing together the edge of a plurality of parts, comprising:

a clamp assembly for securing together the parts to be sewn;

a rotation assembly for enabling said clamp assembly and parts to passively rotate about a first rotational axis through said clamp assembly and parts; a sewing machine having a needle reciprocably driven along a needle axis transverse to said clamp assembly and parts;

a linear bearing assembly for enabling said clamp assembly and parts to passively translate along a linear axis between said first rotational axis and said needle axis;

a steering assembly rotatable about a second rotational axis parallel to said needle axis for adjusting the angle of said first rotational axis about said needle axis;

a feed mechanism for feeding said parts through the needle axis;

an edge sensor for sensing the position of the edge of the parts proximate said needle axis; and control means, responsive to said edge sensor for rotating said steering assembly and for driving said feed mechanism to feed the parts through the needle axis while the clamp assembly and parts passively float about said first rotational axis and along said linear axis to enable the parts to be sewn accurately, automatically proximate their edges.

2. The automatic edge sewing system of claim 1 in which said clamp assembly includes a pair of plates.

3. The automatic edge sewing system of claim 2 in which said clamp assembly includes a linear actuator for urging together said plates with the parts to be sewn between them.

4. The automatic edge sewing system of claim 1 in which said rotation assembly includes a rotary beating mechanism.

5. The automatic edge sewing system of claim 4 in which said rotary bearing mechanism includes a rotary bearing associated with each said plate.

6. The automatic edge sewing system of claim 1 in which said first rotational axis is the centroidal axis of said clamp assembly and parts.

7. The automatic edge sewing system of claim 1 in which said second rotational axis is coincident with said needle axis.

8. The automatic edge sewing system of claim 1 in which said edge sensor includes a retro-reflective proximity sensor.

9. The automatic edge sewing system of claim 1 in which said control means includes a steering drive for operating said steering assembly, a feed drive for operating said feed mechanism and a microprocessor, responsive to said edge sensor, said steering drive and said feed drive, for controlling said steering drive and said feed drive.

10. The automatic edge sewing system of claim 9 in which said steering drive includes a position encoder and said feed drive includes a position encoder.

11. The automatic edge sewing system of claim 1 further including a comer sensor for detecting when a comer of the edge of said parts is approaching said needle axis.

12. An automatic edge sewing method for sewing together the edge of a plurality of parts, comprising:

clamping together the parts to be sewn in a sewing machine having a reciprocating needle;

mounting the parts for rotation about a first rotational axis through the parts and for linear translation along a linear axis between the first rotational axis and the axis of the needle;

steering the parts about a second rotational axis parallel to the needle axis for adjusting the angle of the first rotational axis about the needle axis;

feeding the parts through the needle axis;

sensing the position of the edge of the parts proximate the needle axis; and controlling the steering and feeding of the parts through the needle axis in response to the sensing of the edge position while the parts passively float about the first rotational axis and along the linear axis to enable the parts to be sewn accurately, automatically, proximate the edges.

13. The automation edge sensing method of claim 12 in which said first rotational axis is the centroidal axis of the parts.

14. The automation edge sensing method of claim 12 in which said second rotational axis is coincident with said needle axis.

* * * * *